US011852388B2

(12) United States Patent
Kniffler et al.

(10) Patent No.: US 11,852,388 B2
(45) Date of Patent: Dec. 26, 2023

(54) HEAT PUMP ARRANGEMENT HAVING A CONTROLLABLE HEAT EXCHANGER AND METHOD FOR PRODUCING A HEAT PUMP ARRANGEMENT

(71) Applicant: Efficient Energy GmbH, Feldkirchen (DE)

(72) Inventors: Oliver Kniffler, Sauerlach (DE); Jürgen Süss, Bodolz (DE)

(73) Assignee: EFFICIENT ENERGY GMBH, Feldkirchen (DE)

( * ) Notice: Subject to any disclaimer, the term of this patent is extended or adjusted under 35 U.S.C. 154(b) by 261 days.

(21) Appl. No.: 16/737,321

(22) Filed: Jan. 8, 2020

(65) Prior Publication Data

US 2020/0141615 A1 May 7, 2020

Related U.S. Application Data

(63) Continuation of application No. PCT/EP2018/069166, filed on Jul. 13, 2018.

(30) Foreign Application Priority Data

Jul. 14, 2017 (DE) ..... 10 2017 212 131.9

(51) Int. Cl.
*F25B 30/06* (2006.01)
*F25B 30/02* (2006.01)
*F25B 49/02* (2006.01)

(52) U.S. Cl.
CPC ..... *F25B 30/06* (2013.01); *F25B 30/02* (2013.01); *F25B 49/02* (2013.01); *F25B 2500/02* (2013.01); *F25B 2500/09* (2013.01); *F25B 2500/29* (2013.01); *F25B 2500/31* (2013.01)

(58) Field of Classification Search
CPC ..... F25B 30/06; F25B 30/02; F25B 49/02; F25B 2500/02; F25B 2500/09;
(Continued)

(56) References Cited

U.S. PATENT DOCUMENTS 4,495,777 A * 1/1985 Babington ..... F25D 17/02 62/185
2006/0010893 A1 1/2006 Dominguez
(Continued)

FOREIGN PATENT DOCUMENTS

CN 201237397 Y 5/2009
CN 103568777 A 2/2014
(Continued)

OTHER PUBLICATIONS

Office Action in the parallel CN patent application No. 201880046963.1, dated Jan. 7, 2021, with English Translation.
(Continued)

*Primary Examiner* — Larry L Furdge
(74) *Attorney, Agent, or Firm* — McClure, Qualey & Rodack, LLP

(57) ABSTRACT

A heat pump arrangement includes a heat pump device, an evaporator cycle interface for inputting liquid to be cooled into the heat pump device and for outputting cooled liquid out of the heat pump device, a condenser cycle interface for inputting liquid to be heated into the heat pump device and for outputting heated liquid out of the heat pump device, a controllable heat exchanger for controllably coupling the evaporator cycle interface and the condenser cycle interface, and a control for controlling the controllable heat exchanger in dependence on an evaporator cycle temperature in the evaporator cycle interface or a condenser cycle temperature in the condenser cycle interface.

15 Claims, 13 Drawing Sheets

(58) Field of Classification Search
CPC ..... F25B 2500/29; F25B 2500/31; F25B 2339/047; F25B 25/005; F24F 5/0089
See application file for complete search history.

(56) References Cited

U.S. PATENT DOCUMENTS

| | | | | |
|---|---|---|---|---|
| 2007/0095081 | A1 | 5/2007 | Ootori et al. | |
| 2007/0095519 | A1* | 5/2007 | Hombucher | F24F 12/003 165/240 |
| 2011/0107787 | A1* | 5/2011 | Sedlak | F25B 30/06 62/434 |
| 2015/0068228 | A1 | 3/2015 | Sedlak et al. | |
| 2016/0178262 | A1 | 6/2016 | Rocha et al. | |
| 2017/0182864 | A1 | 6/2017 | Heyl | |
| 2018/0209701 | A1* | 7/2018 | Perrotin | F25B 25/005 |

FOREIGN PATENT DOCUMENTS

| | | | |
|---|---|---|---|
| CN | 204880847 | U | 12/2015 |
| DE | 10 2012 208 174 | B4 | 11/2013 |
| EP | 0467189 | A2 | 1/1992 |
| WO | 01/65188 | A1 | 9/2001 |
| WO | 2017/013461 | A1 | 1/2017 |

OTHER PUBLICATIONS

International Search Report, dated Oct. 5, 2018.
International Search Report and Written Opinion of the International Searching Authority, dated Oct. 5, 2018.

* cited by examiner

| | temperature range | exemplary temperature | sensor values | control amount | free cooling |
|---|---|---|---|---|---|
| mode with (two-way) switch | cold | <10°C | TWK>TWW | PK speed<br>HE active | YES |
| | medium cold | 10°C - 16°C | TWK>TWW | HE active<br>radial wheel speed | YES |
| | warm | 16°C - ... | TWK<TWW | HE inactive<br>radial wheel speed | NO |
| special mode with mixer | very warm | 26°C - ... | TWK<TWW | controllable<br>short circuit | NO |
| | | | clocking frequency | possibly proportional control | NO |

Fig. 7

HEAT PUMP ARRANGEMENT HAVING A CONTROLLABLE HEAT EXCHANGER AND METHOD FOR PRODUCING A HEAT PUMP ARRANGEMENT

CROSS-REFERENCE TO RELATED APPLICATIONS

This application is a continuation of copending International Application No. PCT/EP2018/069166, filed Jul. 13, 2018, which is incorporated herein by reference in its entirety, and additionally claims priority from German Application No. 10 2017 212 131.9, filed Jul. 14, 2017, which is also incorporated herein by reference in its entirety.

The present invention relates to heat pump applications and in particular to heat pump applications usable for cooling, for heating or for other purposes where heat has to be pumped from one level to another level.

BACKGROUND OF THE INVENTION

Typical fields of usage of heat pumps are cooling of a region to be cooled and/or heating of a region to be heated. For that purpose, a heat pump, typically consisting of an evaporator, a compressor, a liquefier and a throttle, includes an evaporator side on the one hand and a liquefier side on the other hand. Depending on the implementation, a heat pump is coupled to a heat exchanger on the evaporator side and/or a heat exchanger on the liquefier side.

If the heat pump is used as cooling unit, the region to be cooled is the "useful side". The region to be cooled can, for example, be an interior space, such as a computer room or another room to be cooled or to be air-conditioned. Then, the region to be heated is, for example, the outside wall of a building or a top side of a roof and another region to which the exhaust heat is to be directed. If, however, the heat pump is used as a heater, the region to be heated is, so to speak, the "useful side" and the region to be cooled would, for example, be ground earth, ground water or the same.

For a general heat pump application, it is problematic that the configuration does not consider that the environmental temperature of the region to be heated varies heavily, when the same is outdoors, for example. Therefore, it can be the case that temperatures of −20° C. in winter and temperatures of more than 30° C. in summer prevail. When considering, for example, an application where a computer room is air-conditioned, it would be sufficient to no longer air-condition the computer room but merely "open the windows" for the case that the outside temperature is, for example, within the range or below the set temperature of the region to be cooled. However, this is problematic since computer rooms do not necessarily have windows, and even when such cooling is considered, it is quite difficult to control that a uniform temperature is achieved in the room. If there are any windows at all, cold zones may be formed close to the windows, for example, while warm zones may be formed further away from the windows or behind certain computer racks that might then not be sufficiently cooled. On the other hand, it is problematic that the fact that outside temperatures can vary heavily and are frequently within ranges where cooling is usually not needed is not used in a heat pump configuration. For that reason, a configuration as generally used is configured for the worst-case situation, e.g., for a very hot summer day although, on average, such a hot summer day is a rare event, at least in Germany, and most of the time of the year temperatures prevail where the needed cooling capacities are far below the assumed worst-case situation.

DE 10 2012 208 174 B4 shows a heat pump and a method for pumping heat in the free cooling mode. The heat pump includes an evaporator having an evaporator inlet and an evaporator outlet, a compressor for compressing operating liquid evaporated in the evaporator and a liquefier for liquefying evaporating liquid compressed in the compressor. Further, the liquefier has a liquefier inlet and a liquefier outlet. In the free cooling mode, the evaporator inlet is connected to a return from a region to be heated. Above that, the liquefier inlet is connected to a return from a region to be cooled. Further, a switch means is provided to separate the evaporator inlet from the return from the region to be heated and to connect the return from the region to be cooled to the evaporator inlet and to further separate the liquefier inlet from the return of the region to be cooled and, additionally, to connect the return from the region to be heated to a liquefier inlet. Thereby, switching from the free cooling mode to the normal mode and back to the free cooling mode can be performed. Thus, it is efficiently considered that outside temperatures are frequently within ranges far below the maximum temperatures when the heat pump is not operated in the classical configuration but in the configuration where the return from the region to be heated is connected to the evaporator inlet and the return from the region to be cooled is connected to the liquefier inlet.

In this free cooling mode, the fact is used that the return temperature from the region to be heated already reaches the order of the temperature normally provided to the evaporator. Above that, the fact is used that the return from the region to be cooled is already within such temperature regions that can be provided to the liquefier of the heat pump. This has the effect that the temperature difference that the heat pump normally has to achieve between the evaporator outlet and the liquefier outlet decreases rapidly compared to the normal mode. Since the temperature difference to be achieved by a heat pump is incorporated in the consumed drive power for the compressor in a squared manner, this results in an efficiency increase of the heat pump compared to a normal configuration without free cooling mode.

Depending on the application, it can happen that the flexibility of the free cooling mode, where the liquefier inlets/outlets are actually switched and hence both the evaporator cycle as well as the condenser cycle is fluidically switched back and forth, is reduced. Above that, switching from the condenser cycle at high pressure to the evaporator cycle at low pressure and vice versa is needed, which can be problematic depending on the embodiment.

U.S. Pat. No. 4,495,777 discloses a load distribution system for a closed cooling system.

US 2006/0010893 A1 discloses a cooling system with a low capacity control.

SUMMARY

According to an embodiment, a heat pump arrangement may have: a heat pump device; an evaporator cycle interface for inputting liquid to be cooled into the heat pump device and for outputting cooled liquid out of the heat pump device; a condenser cycle interface for inputting liquid to be heated into the heat pump device and for outputting heated liquid out of the heat pump device; a controllable heat exchanger for controllably coupling the evaporator cycle interface and the condenser cycle interface; and a control for controlling the controllable heat exchanger in dependence on an evaporator cycle temperature in the evaporator cycle interface or a condenser cycle temperature in the condenser cycle interface, wherein the controllable heat exchanger includes a heat exchanger unit with terminals and two fluidically separated paths and at least one control element, wherein at least one terminal of the heat exchanger unit is coupled to at least one terminal of the at least one control element in order to effect, reduce or prevent flow through one of the paths of the heat exchanger unit in dependence on a setting of the control element, and wherein the at least one control element is configured as two-way switch or as mixer.

According to another embodiment, a heat pump system may have: a region to be cooled; a region to be heated; an inventive heat pump arrangement, wherein the evaporator cycle interface of the heat pump system is coupled to the region to be cooled, wherein the condenser cycle interface is coupled to the region to be heated.

According to another embodiment, a method for producing a heat pump arrangement with a heat pump device may have the steps of: inputting liquid to be cooled into the heat pump device and outputting cooled liquid out of the heat pump device; inputting liquid to be heated into the heat pump device and outputting heated liquid out of the heat pump device; coupling liquid cooled by a heat sink in a controllable and thermal manner to the liquid to be cooled via a controllable heat exchanger in dependence on an evaporator cycle temperature including a temperature of the liquid to be cooled or the cooled liquid or in dependence on a condenser cycle temperature including a temperature of the liquid to be heated or the heated liquid or the liquid cooled by the heat sink, wherein the controllable heat exchanger includes a heat exchanger unit with terminals and two fluidically separated paths and at least one control element, wherein at least one terminal of the heat exchanger unit is coupled to at least one terminal of the at least one control element in order to effect, reduce or prevent flow through one of the paths of the heat exchanger unit in dependence on a setting of the control element, and wherein the at least one control element is configured as two-way switch or as mixer.

An inventive heat pump arrangement includes a heat pump device and an evaporator cycle interface for inputting liquid to be cooled into the heat pump device and for outputting cooled liquid out of the heat pump device. Further, the heat pump arrangement includes a condenser cycle interface for inputting liquid to be heated into the heat pump device and for outputting heated liquid out of the heat pump device. Above that, a controllable heat exchanger is provided for controllably coupling the evaporator cycle interface and the condenser cycle interface. Further, a control is provided for controlling the controllable heat exchanger in dependence on an evaporator cycle temperature in the evaporator cycle interface or in dependence on a condenser cycle temperature in the condenser cycle interface. Further, depending on the implementation, an evaporator cycle temperature sensor for detecting the evaporator cycle temperature or a condenser cycle temperature sensor for detecting the condenser cycle temperature or both sensors are present. In the latter case, the control is configured to control the controllable heat exchanger based on a difference of the evaporator cycle temperature and the condenser cycle temperature or based on a comparison of the temperatures in order to actually controllably couple the output side, i.e., the condenser cycle, and the input side, i.e., the evaporator cycle. According to the invention, however, no liquid coupling of the condenser cycle interface and the evaporator cycle interface takes place. Instead, merely thermal coupling of the output side and the input side takes place via the heat exchanger such that the operating liquid in the condenser cycle interface is thermally coupled to the operating liquid of the evaporator cycle interface but not directly fluidically coupled.

Thereby, it is ensured that control elements existing in the controllable heat exchanger in addition to a common heat exchanger with two separate liquid paths only have to switch in the same pressure region, i.e., only in the condenser cycle interface or the evaporator cycle interface but do not establish a fluidic short circuit between the two interfaces.

In embodiments, the control element is configured to effect, reduce or suppress flow through one of the paths in dependence on a setting of the control element. In the case of effecting the flow or suppressing the flow, the control element is configured as two-way control element having a switched-on and a switched-off state. In the case of reducing the flow through one of the two paths, the control element is configured as mixer in order to pass one part of the operating liquid via the controllable heat exchanger and another part past the controllable heat exchanger, depending on the implementation.

In one embodiment, the controllable heat exchanger comprises a heat exchange unit with terminals and two fluidically separate paths and at least one control element, wherein at least one terminal of the heat exchanger unit is coupled to at least one terminal of the at least one control element in order to effect, reduce or prevent flow through one of the paths of the heat exchanger unit in dependence on a setting of the control element. Further, the at least one control element is configured as two-way switch or as mixer.

In a further embodiment, the at least one control element is configured as passive two-way switch in order to effect or prevent the flow through one of the paths of the heat exchanger unit in dependence on the setting of the passive two-way switch, or the same is configured as passive mixer in order to reduce the flow through one of the paths of the heat exchanger unit in dependence on the setting of the mixer. Here, passive means that the two-way switch or the mixer does not include any own pump. In further embodiments, the passive elements also include no valves.

The controllable heat exchanger is incorporated such that one path of the heat exchanger is continuously flowed-through and that the other path can be switched on or off, or in the case of using a mixer, can be throttled with regard to an on-state. Depending on the implementation, power electronics to be cooled are arranged on the controllable heat exchanger or at least in thermal effective contact, due to the fact that the controllable heat exchanger is flowed-through from at least one side. In this implementation, where the controllable heat exchanger is simultaneously used as heat sink, i.e., as cooling for needed electronic parts, such as for a frequency converter of the compressor engine, coupling takes place such that the condenser cycle interface continuously flows through a path of the controllable heat exchanger. Thereby, the exhaust heat of the electronic components is moved directly into the heat dissipation means typically provided for the heat pump arrangement such as a recooler on the roof or on a shadow side of the building, even when free cooling is not activated and the other path of the heat exchanger unit is not flowed-through.

The present invention is advantageous in that the input side and the output side, i.e., the evaporator cycle and the condenser cycle can be thermally coupled by the controllable heat exchanger but are not fluidically coupled. Thereby, it is obtained that different operating liquids can be used in the condenser cycle on the one hand and in the evaporator cycle on the other hand. Above that, the requirements for the control element of the controllable heat exchanger are reduced compared to switching liquids with regard to the input side and the output side since the same pressures prevail and the pressure difference from the input side of the heat pump arrangement, i.e., the evaporator cycle and the output side of the heat pump arrangement, i.e., the condenser cycle, cannot reach the one and same switch element.

Above that, coupling of the two interfaces with the controllable heat exchanger provides more flexibility in that not only a free cooling mode can be implemented where the operating liquid flowing back from the heat exchanger is used in order to directly cool the liquid to be cooled but that vice versa also a controlled short circuit of the heat pump arrangement can be obtained, which can be useful when excessive clocking with switch-on and switch-off events would take place without the heat pump. Such a situation can occur, for example, when the system is in partial load operation. If the system needs high pressure increase when the cooling capacity is too low, which can be the case, for example with partial power in the data center and at high environmental temperatures, this would cause too large a volume flow and hence too large a mass flow. This would result in clocking the heat pump arrangement with alternating on-off-on states. By implementing the controllable heat exchanger by means of a controllable mixer, a controllable power short circuit between cold and cooling water can be provided which improves the partial load behavior and effectively prevents clocking.

Therefore, the heat pump arrangement according to the present invention has, on the one hand, increased flexibility regarding the connection of different liquids in the condenser cycle on the one hand and the evaporator cycle on the other hand. Above that, thermal coupling enables usage of simpler and more cost effective control elements instead of the actual fluidic coupling of the two sides. Finally, based on thermal coupling, not only a free cooling mode can be used for increasing the efficiency of the heat pump but at the same time a controllable power short circuit can be used for improving the partial load behavior of the system or also for implementing other modes of the system, such as service modes.

BRIEF DESCRIPTION OF THE DRAWINGS

Embodiments of the present invention will be detailed subsequently referring to the appended drawings, in which:

FIG. 7 is a tabular overview on different modes of the heat pump arrangement.

DETAILED DESCRIPTION OF THE INVENTION

Figure 1:
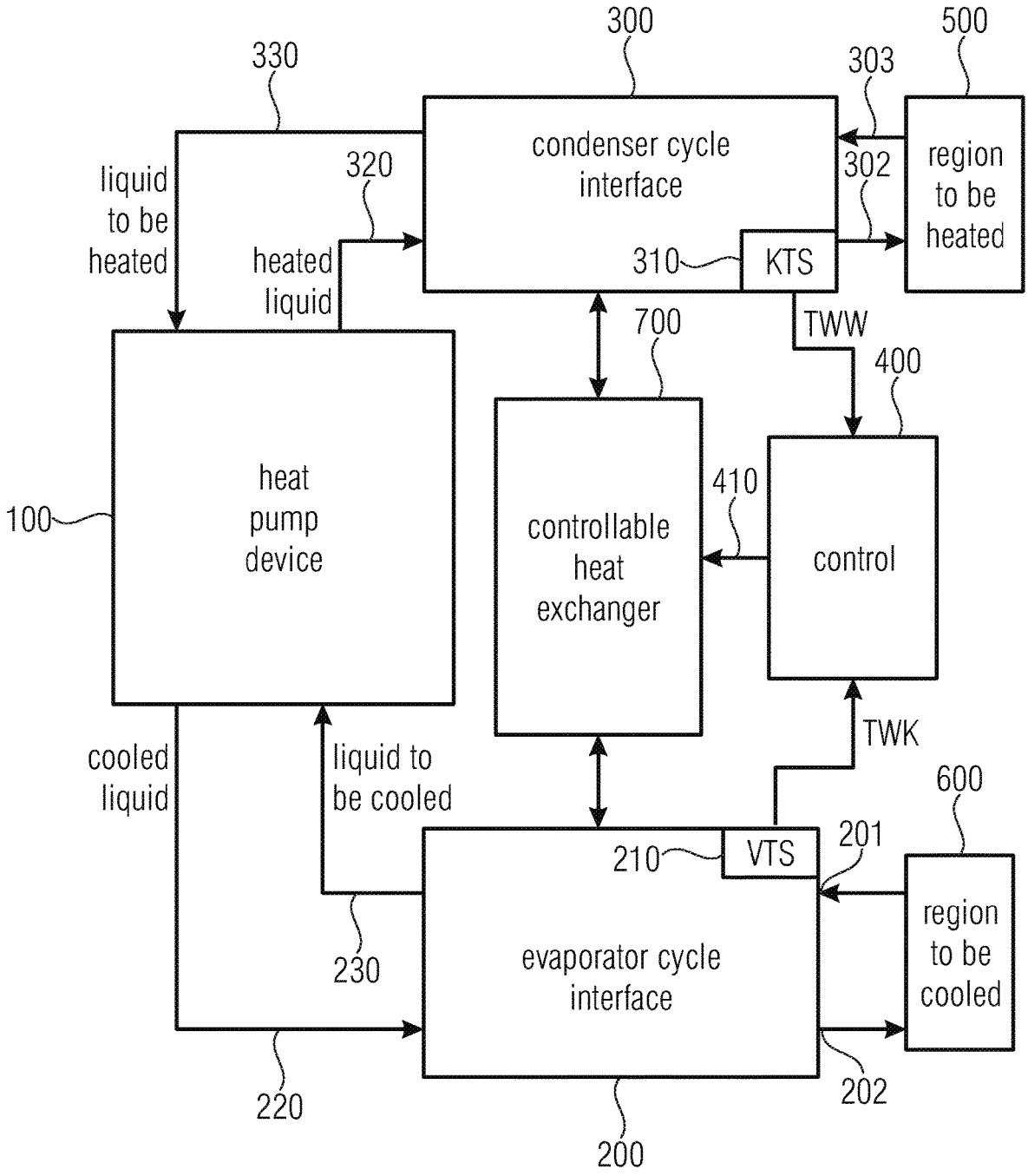
FIG. 1 is a block diagram of a heat pump arrangement according to an embodiment of the present invention.

FIG. 1 shows a heat pump arrangement with a heat pump device 100. The heat pump device 100 further includes an evaporator cycle interface 200 for inputting liquid to be cooled 230 into the heat pump device 100 and for outputting cooled liquid 220 out of the heat pump device 100. Further, the heat pump device 100 includes a condenser cycle interface 300 for inputting liquid to be heated 330 into the heat pump device 100 and for outputting heated liquid 320 out of the heat pump device 100. Above that, a controllable heat exchanger 700 is provided to controllably couple the evaporator cycle interface 200 and the condenser cycle interface 300. Further, in specific implementations, an evaporator cycle temperature sensor 210 (VTS) for detecting an evaporator cycle temperature is provided. Above that, a condenser cycle temperature sensor 310 (KTS) for detecting a condenser cycle temperature is provided. Above that, the heat pump arrangement according to the present invention is provided with a control 400 for controlling the controllable heat exchanger 700, wherein this control operates in dependence on the evaporator cycle temperature, also referred to as TWK, or in dependence on the condenser cycle temperature, also referred to as TWW. The control can either operate by using merely a single temperature, i.e., either the condenser cycle temperature TWW or the evaporator cycle temperature TWK. However, it is advantageous that both temperatures are used, such that two different temperature sensors exist to control the controllable heat exchanger via the control line 410 based on a comparison or based on a difference of the two temperatures.

Figure 4A:
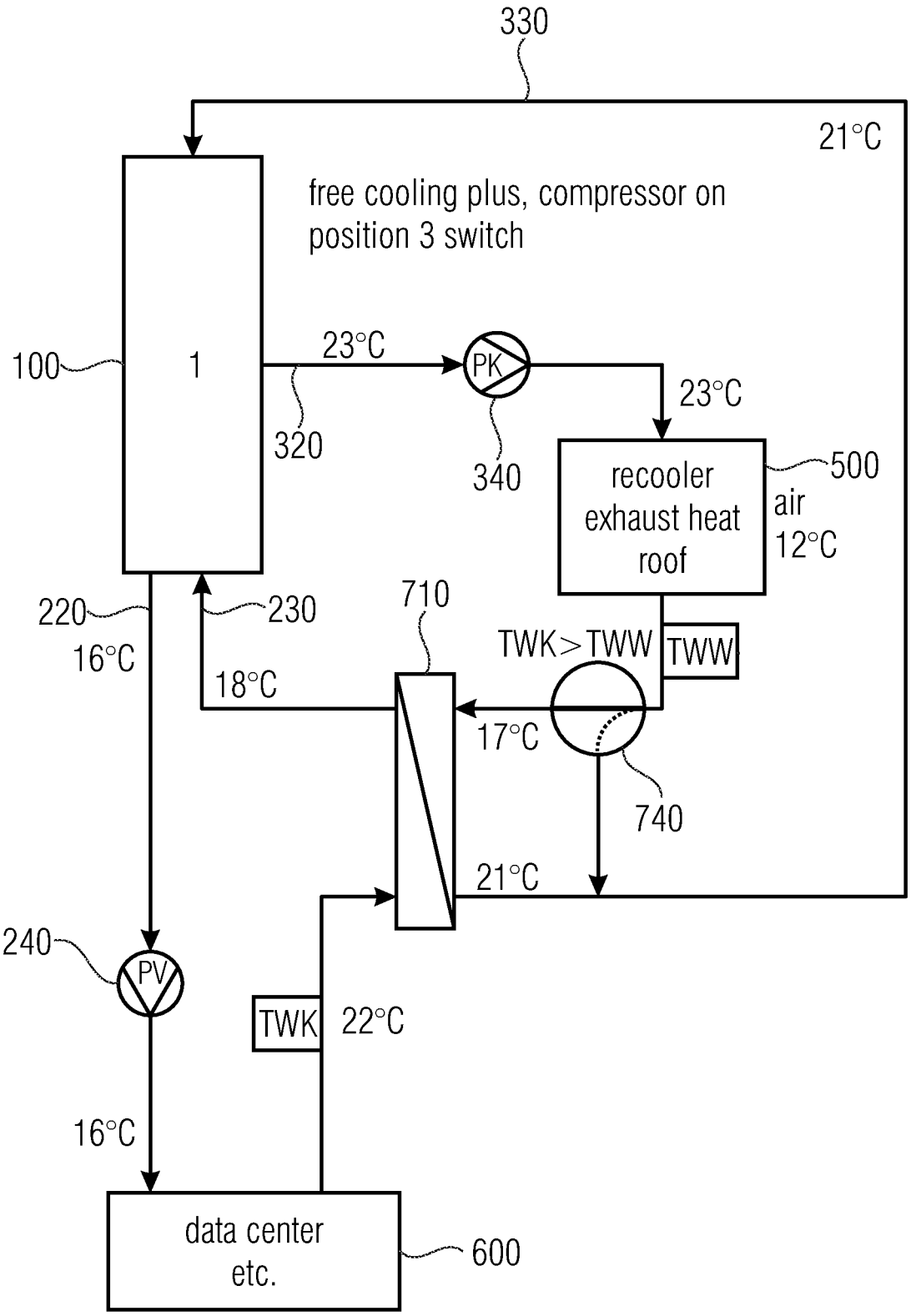
FIG. 4*a* is an implementation of the heat pump arrangement with a control element coupled to the condenser cycle interface and showing an activated flow through the controllable heat exchanger.
Figure 4B:
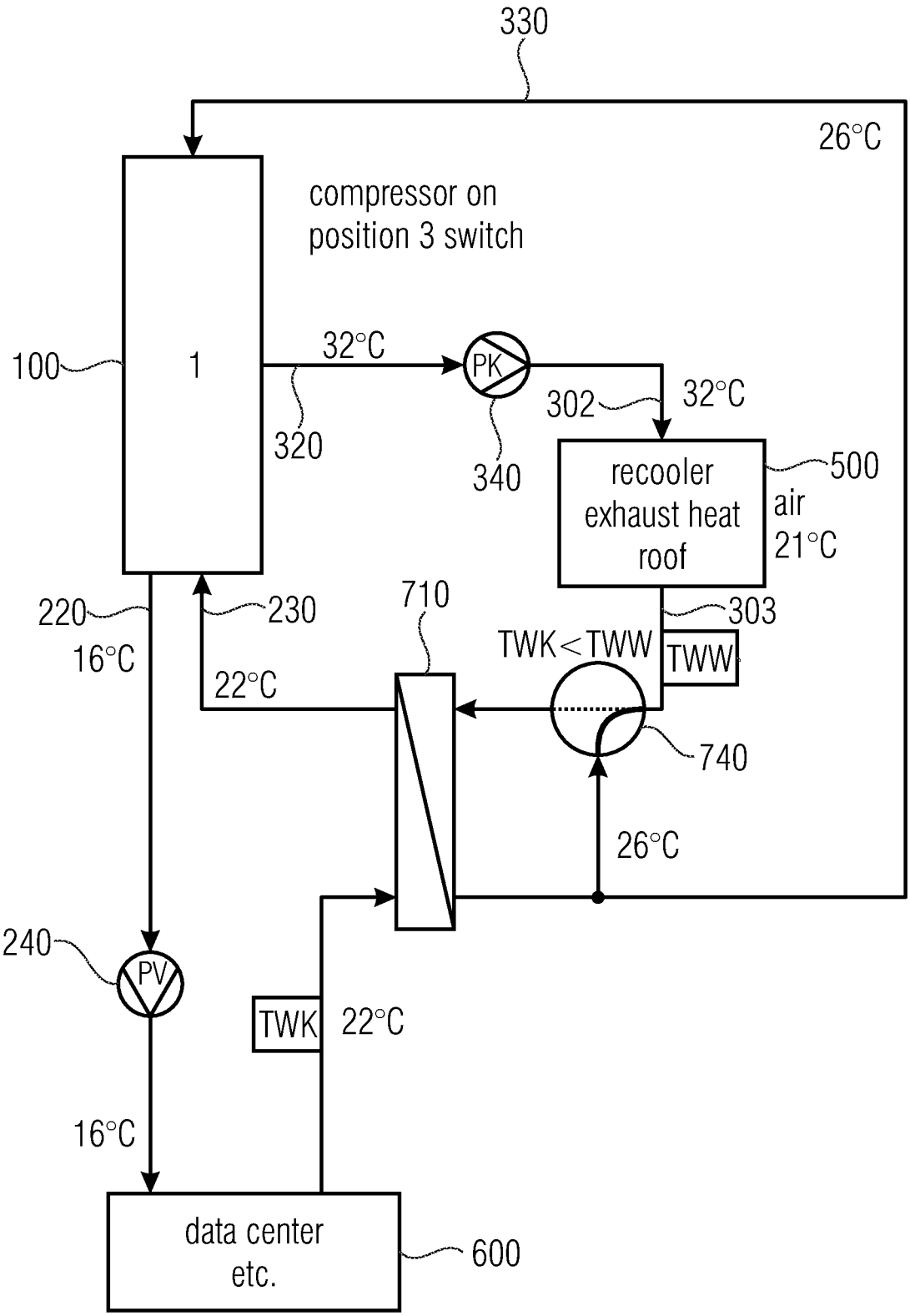
FIG. 4*b* is an implementation similar to FIG. 4*a* but with deactivated flow through the heat exchanger for coupling the evaporator cycle interface and the condenser cycle interface.
Figure 5A:
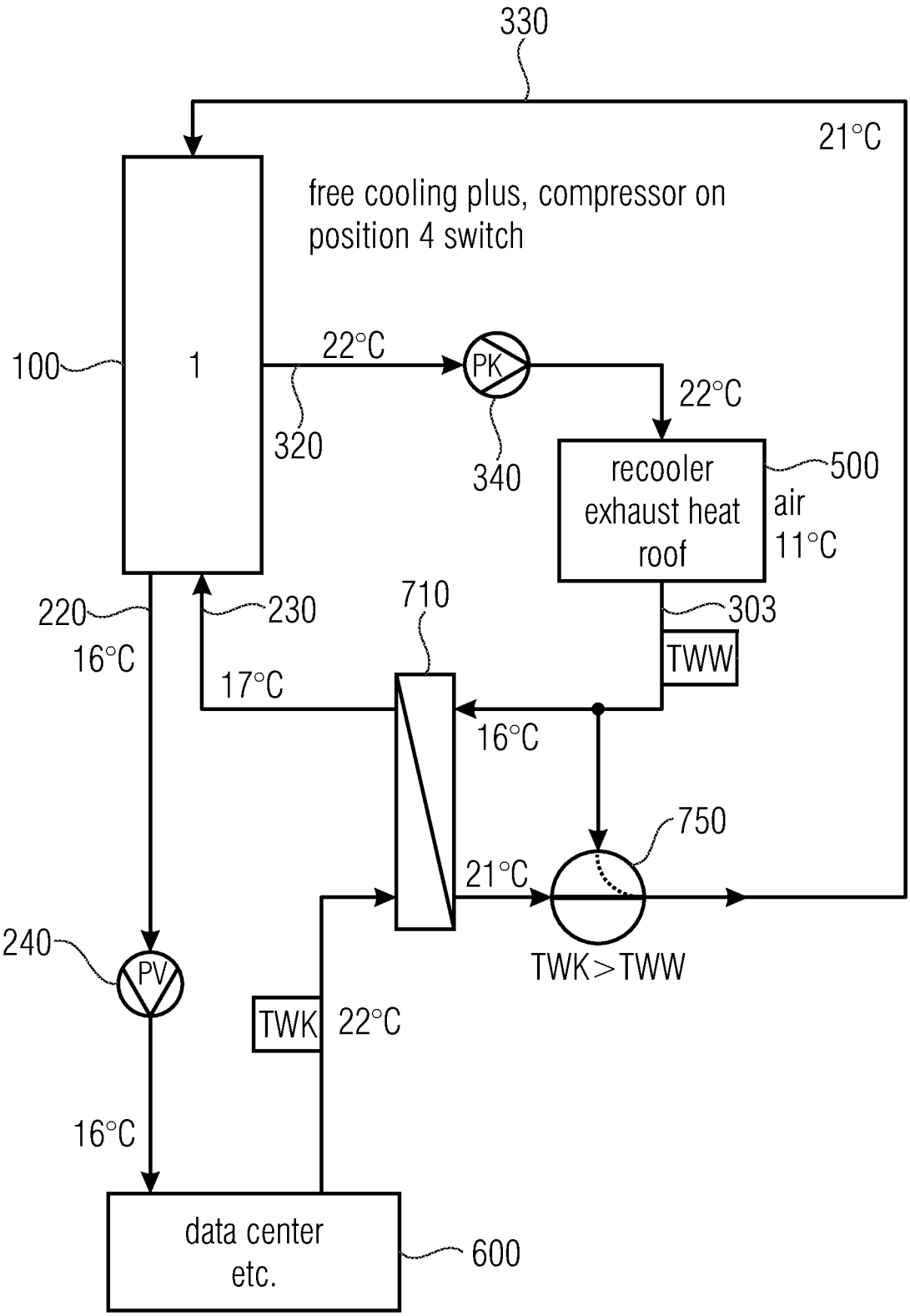
FIG. 5*a* is an embodiment of the heat pump arrangement having a two-way switch coupled to the condenser cycle interface and showing an activated flow through the heat exchanger.
Figure 5B:
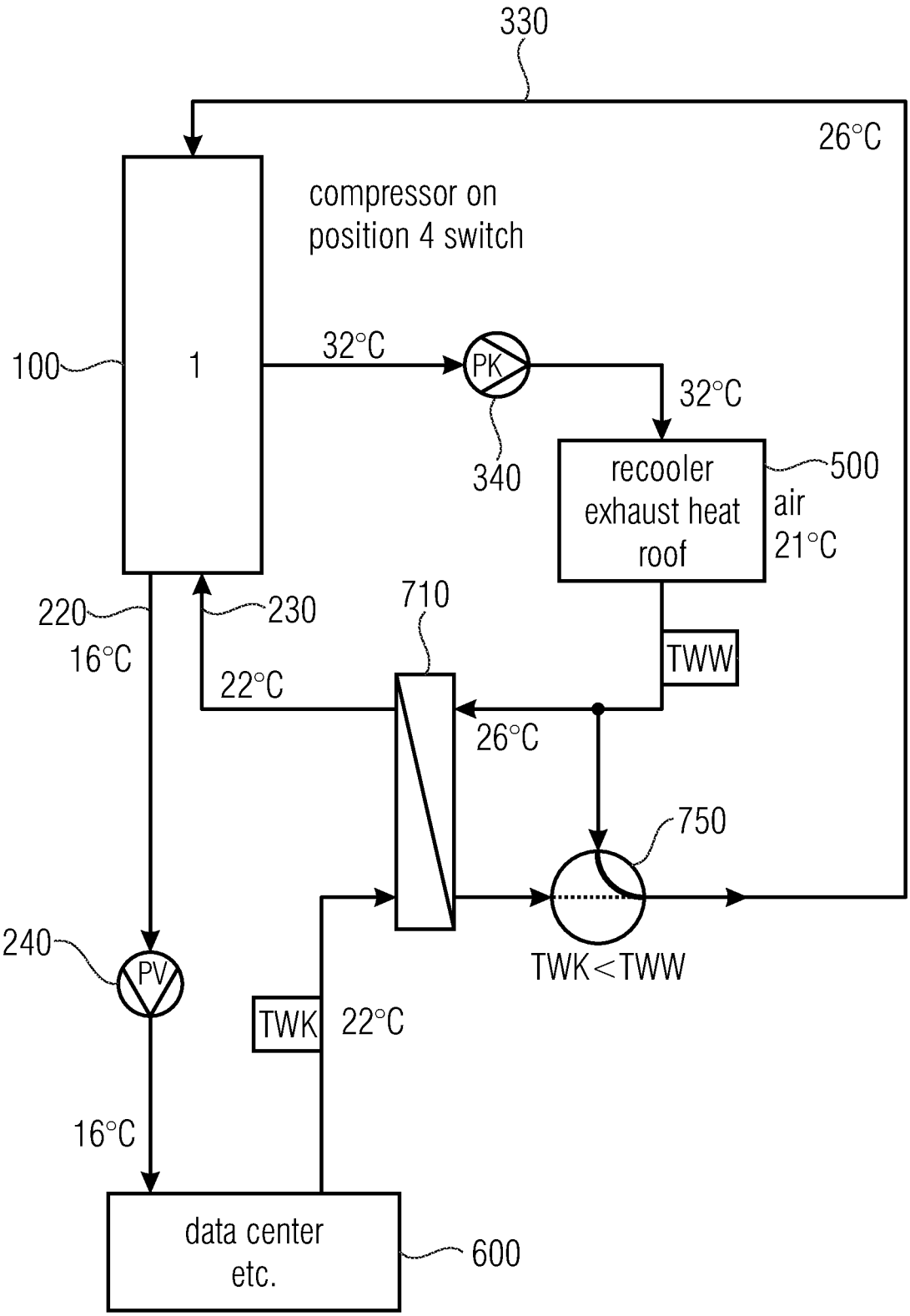
FIG. 5*b* is a heat pump arrangement similar to FIG. 5*a* but with deactivated flow through the controllable heat exchanger, i.e., in a mode which is not the free cooling mode.
Figure 6:
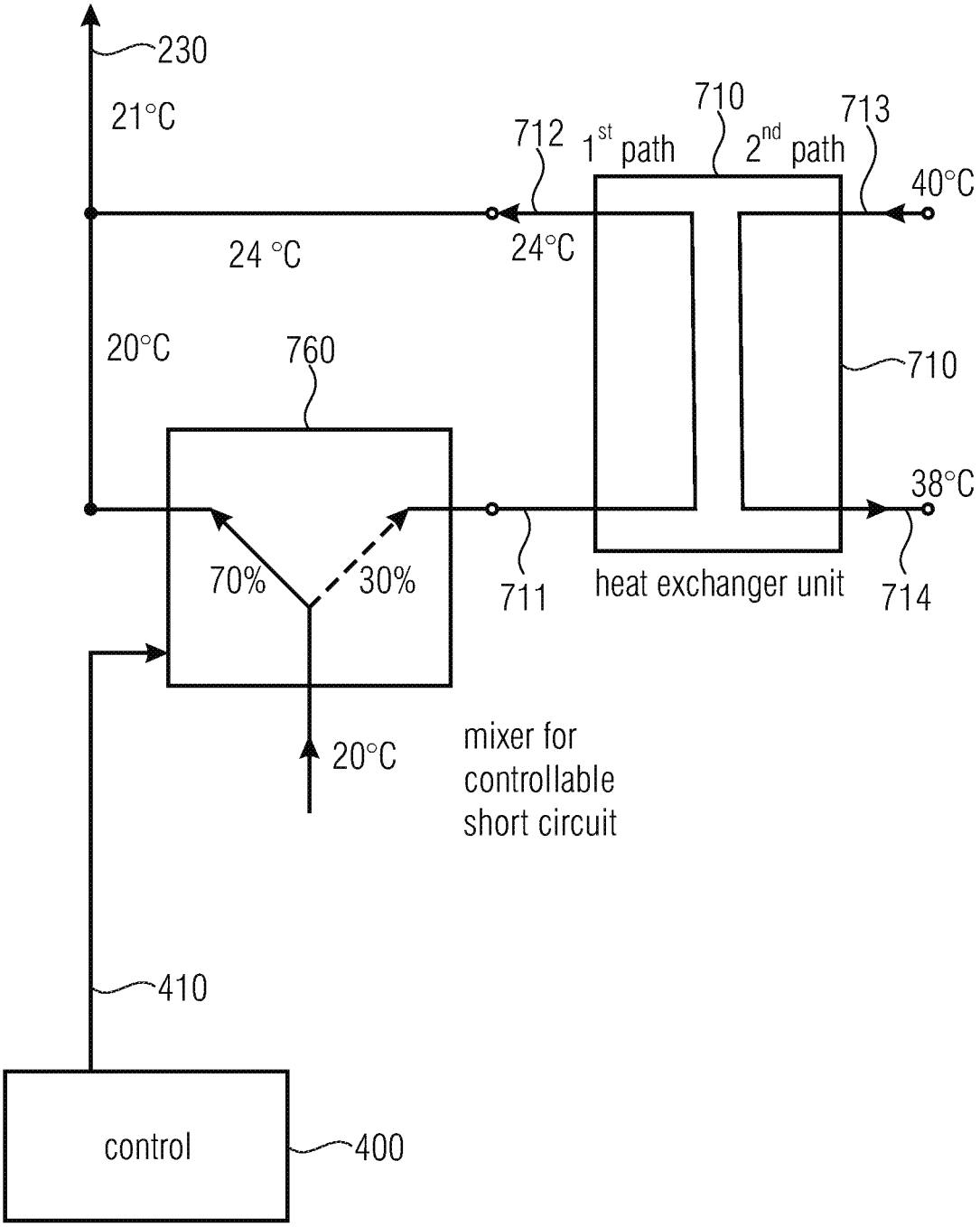
FIG. 6 is a schematic illustration of the controllable heat exchanger as controllable mixer coupled to a two-way heat exchanger.

FIG. 6 shows an embodiment of the controllable heat exchanger showing, on the one hand, a heat exchanger unit 710 and, on the other hand, a control element indicated by 760 in FIG. 6 that is, however, indicated by 720, 730, 740, 750 in FIGS. 2*a* to 5*b*. Thus, the heat exchanger unit includes four inputs 711, 712, 713, 714, wherein the inputs 711, 712 define a first path through the heat exchanger unit 710 and wherein the inputs 713, 714 or terminals 713, 714 define a second path through the heat exchanger unit 710. The two paths, i.e., the first path and the second path are thermally coupled as it is common for a heat exchanger, but are fluidically separated from one another, such that in the heat exchanger unit no liquid can pass from the first path into the second path when the heat exchanger unit is fully operable. Each of the terminals 711, 712, 713, 714 can be an input, wherein then the respective other terminal of the path represents an output, wherein the characteristic of a terminal whether the same is an input or an output can be determined by the flow direction of the operating liquid flowing through. The terminal via which the operating liquid flows into a path of the heat exchanger unit 710 is the input and the terminal from which the liquid flows out is the output.

Thus, depending on the implementation, the controllable heat exchanger comprises a heat exchanger unit having four terminals and two fluidically separate paths, wherein at least one terminal is coupled to a control element, such as a two-way control element and in dependence on a setting of the control element, flow through one of the paths is effected, reduced or suppressed.

Thus, the control element, such as 720, 730, 740, 750, 760 is configured to effect a flow through a path when the condenser cycle temperature is in a predetermined ratio to the evaporator cycle temperature or is less than a predetermined condenser cycle threshold.

Depending on the implementation, the controllable heat exchanger 700 is configured such that one path of the controllable heat exchanger is continuously flowed-through independent of the control and another path of the controllable heat exchanger can be switched on or off or can be throttled by the control with respect to an on-state.

Depending on the implementation, as will be discussed below, the controllable heat exchanger 700 includes a heat exchanger unit, namely the heat exchanger unit 710 of FIG. 6, for example, and FIGS. 2*a* to 5*b*. Here, the control element of the controllable heat exchanger, namely, e.g., elements 720 to 760, is fluidically coupled to a first path of the exchanger element, wherein the control element is further fluidically coupled to the evaporator cycle interface 200.

Above that, the condenser cycle interface 300 is coupled to a second path of the heat exchanger element, such that the liquid to be heated leaves the second path and the heated liquid enters the second path after cooling in a heat sink.

A respective implementation where the controllable element is coupled to the first path of the heat exchanger unit 710 is shown in FIGS. 2*a*, 2*b*, 2*c*, 3*a*, 3*b*.

Figure 2A:
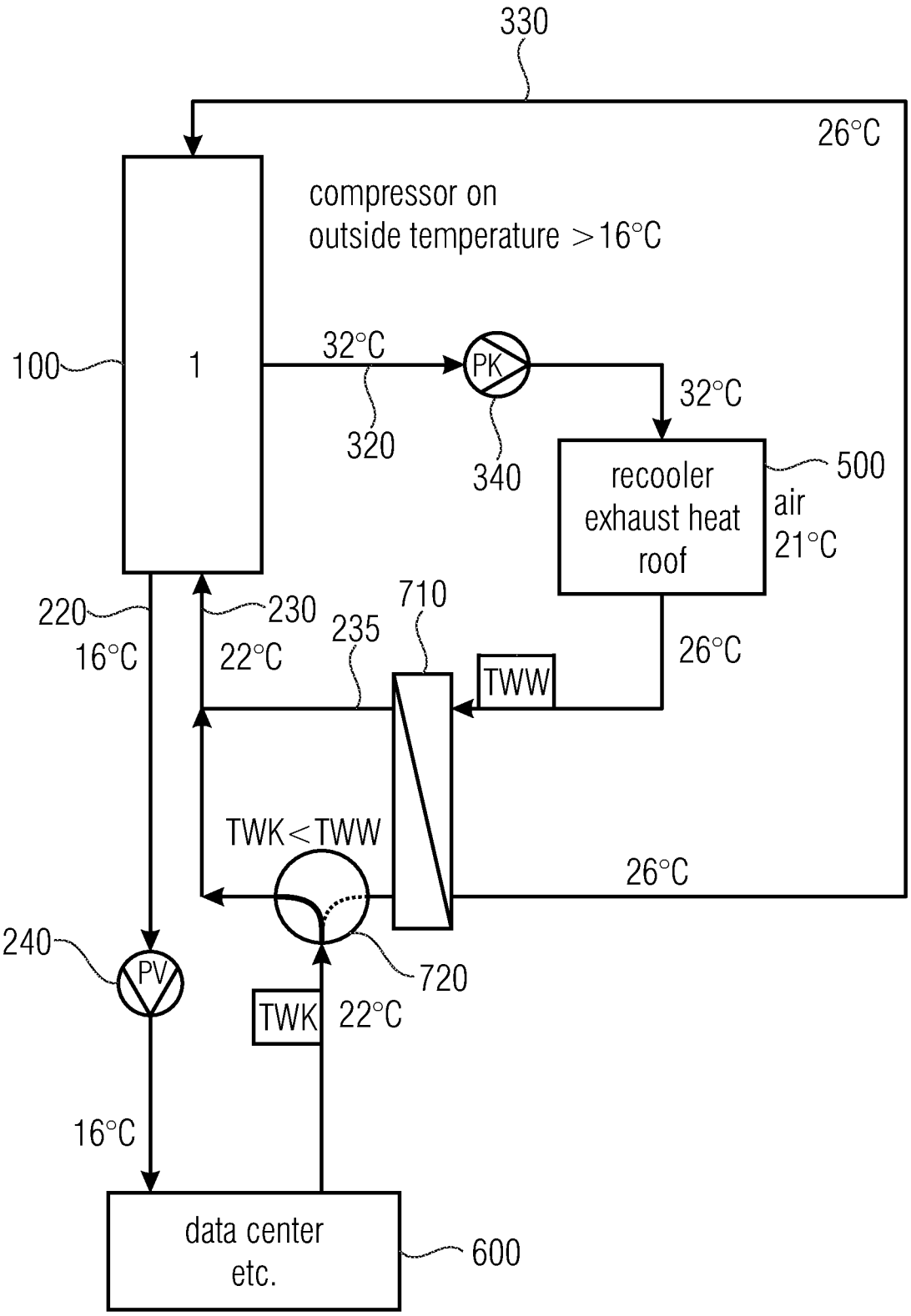
FIG. 2*a* is a heat pump arrangement with a two-way switch coupled to the evaporator cycle interface.

Here, FIG. 2*a* shows an embodiment of the heat pump arrangement wherein the heat pump device 100 is coupled to the evaporator cycle interface 200 as illustrated by lines 220, 230 in FIG. 2*a*. Further, the evaporator cycle interface 200 includes an evaporator pump PV that is configured to pump cooled liquid output by the heat pump device 100 into a region to be cooled 600, which is, for example, a data center. In the example shown in FIG. 2*a*, this liquid has, a temperature of 16° C. and is heated up, for example, to a temperature of 22° C. by the region to be cooled 600 as shown by the evaporator temperature sensor 210 determining the temperature TWK. Thereupon, the heated liquid enters the control element 720 forming the controllable heat exchanger 700 together with the heat exchanger 710. In the embodiment shown in FIG. 2*a*, free cooling is not activated. Instead, the liquid to be cooled is input into the heat pump device 100 in the line 230 past the heat exchanger 710. This is the case since the temperature of a region to be heated, namely, for example, the recooler 500 providing exhaust heat, for example on a roof of a building or on a shadow side of a building, is higher. Here, the temperature after recooling is 26° C. in the embodiment shown in FIG. 2*a* as measured by the condenser cycle temperature sensor 310 outputting the temperature signal TWW. Since the temperature of the re-cooled operating medium is 26° C., i.e., above the liquid temperature level of 22° C. provided by the region to be cooled, a free cooling mode would not bring any advantage. Instead, the free cooling mode is deactivated in that the first path of the heat exchanger unit 710 is not provided with liquid as illustrated by the position of the two-way switch as an example for a control element shown in FIG. 2*a*.

It should further be noted that the condenser cycle interface 300 in FIG. 2*a* also comprises a pump 340 that is configured to bring the heated liquid 320 having, for example, a temperature of 32° C. to the re-cooler 500 or to the region to be heated.

Figure 2B:
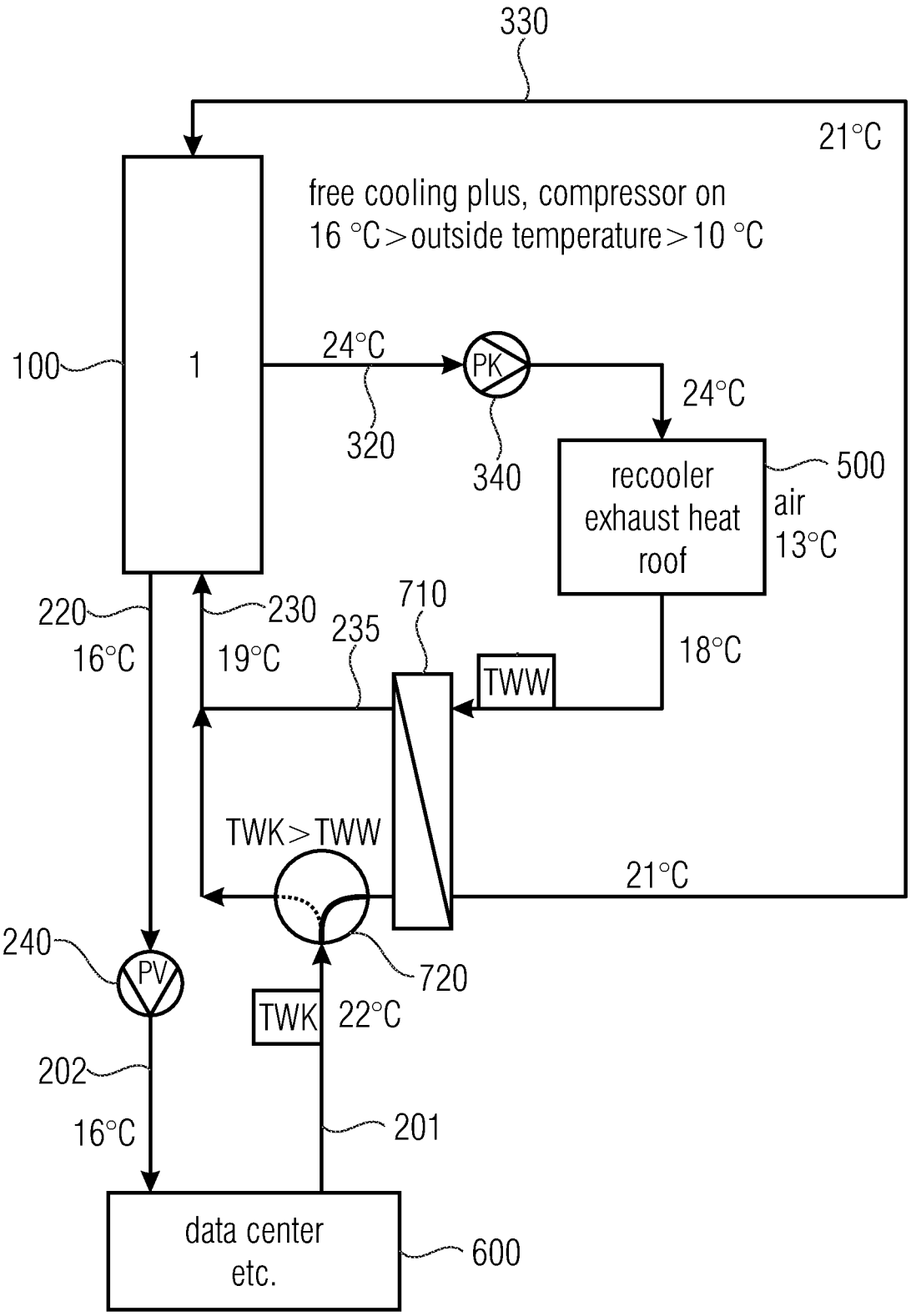
FIG. 2*b* is an implementation similar to the implementation of FIG. 2*a* but with activated heat exchanger flow.

FIG. 2*b* shows again the implementation of FIG. 2*a*, wherein now the control element 720 is switched, namely to the free cooling mode or the mode "free cooling plus" since the temperature at the output of the re-cooler as measured by the temperature sensor 310 is now 18° C., i.e., lower than the temperature returned by the data center. Thus, the two-way switch in FIG. 2*b* is switched such that the first path of the heat exchanger element 710 is provided with the liquid such that heat exchange effects take place in the heat exchanger unit 710. As illustrated, for example, in FIG. 2*b*, the temperature of the liquid coming out of the region to be cooled is cooled from 22° C. to 19° C. Here, the heat pump device 100 has to do considerably less than in the comparative example of FIG. 2*a*. The cooler outside temperature (in FIG. 2*b*, the air has merely a temperature of 13° C.) has been effectively used to reduce the capacity requested from the heat pump device 100.

In the embodiment shown in FIG. 2*b*, the control element 720 is configured as a two-way switch comprising an input and two outputs. Further, the one input of the two-way switch is connected to an output of the region to be cooled, for example the data center 600. This output is typically also provided by the evaporator cycle interface 200 as schematically shown in FIG. 1, by the input 201 of the evaporator cycle interface 200 of FIG. 1. On the other hand, the output of the evaporator cycle interface into the region to be cooled is indicated by 202. Additionally, the output of the pump 240 is connected to the output 202 of the evaporator cycle interface towards the region to be cooled. Above that, the first output of the control element 710 can either be coupled to the first input of the first path of the heat exchanger unit 710 as shown in FIG. 2*b* in order to obtain the free cooling mode or to an input 230 of the heat pump device for liquid to be cooled.

Above that, the second path of the heat exchanger unit is also connected to the input 230 of the heat pump device 100 for liquid to be cooled via a further connecting line 235.

Figure 2C:
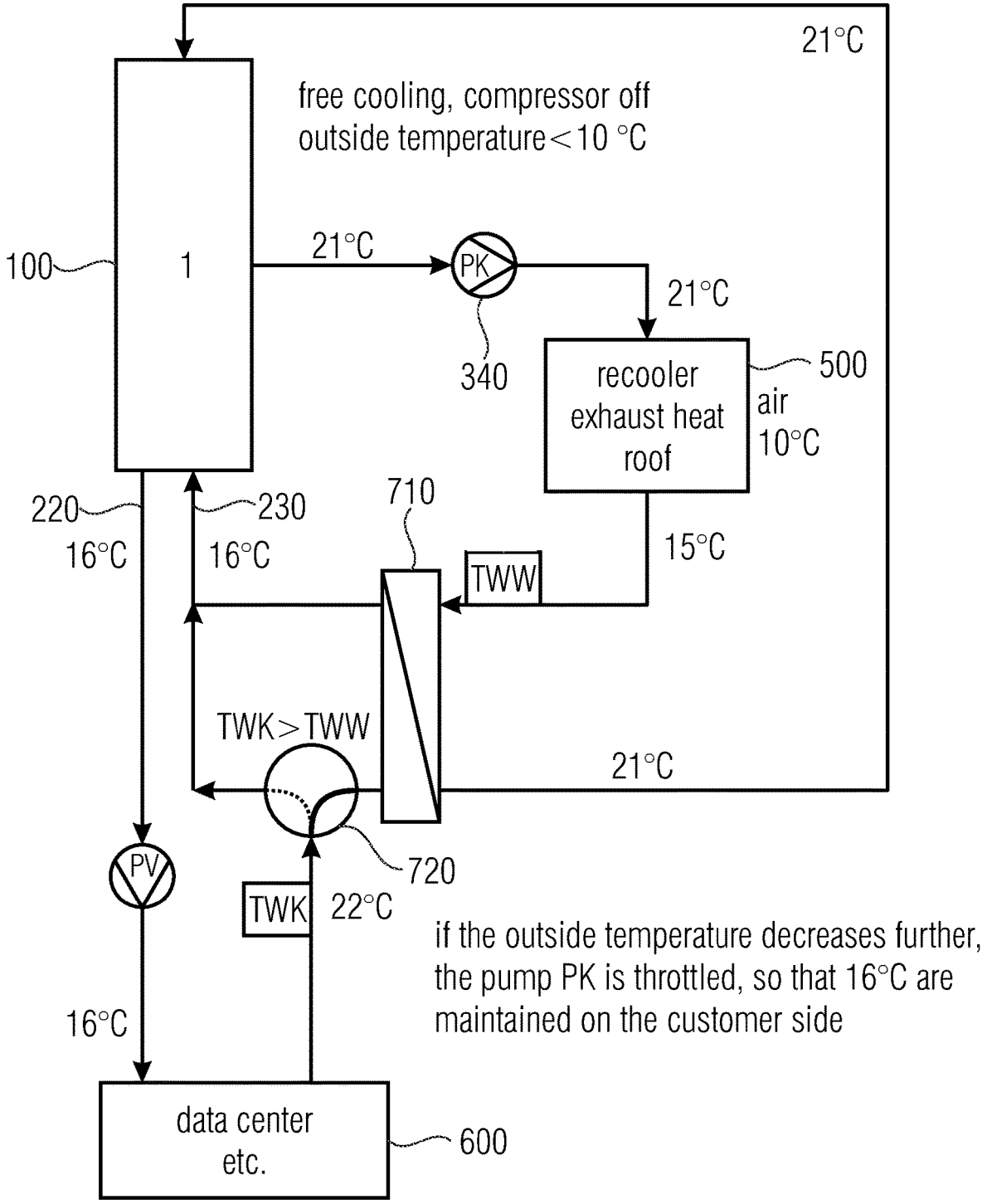
FIG. 2*c* is a similar implementation as in FIG. 2*b* but with switched-off compressor.

FIG. 2*c* shows a further operating mode where due to the cold outside temperature of, for example, 10° C., free cooling is so powerful that the entire data center can be reached without any activities of the compressor in the heat pump device 100. Therefore, the position of the control element 720 in FIG. 2*c* is selected as in FIG. 2*b*. Above that, the compressor is now switched off. Additionally, if the outside temperature decreases further, the pump PK 340 can be throttled so that the minimum temperature of, for example 16° C. requested by the customer is maintained at the output of the pump PV. This means that in the embodiment shown in FIG. 2*c* the compressor of the heat pump device 100 is switched off but the evaporator-side input of the heat pump device 100 is fluidically connected such that the liquid to be cooled on the line 230 and the cooled liquid on the line 220 have the same temperature, namely, for example, the temperature of 16° C.

Figure 3A:
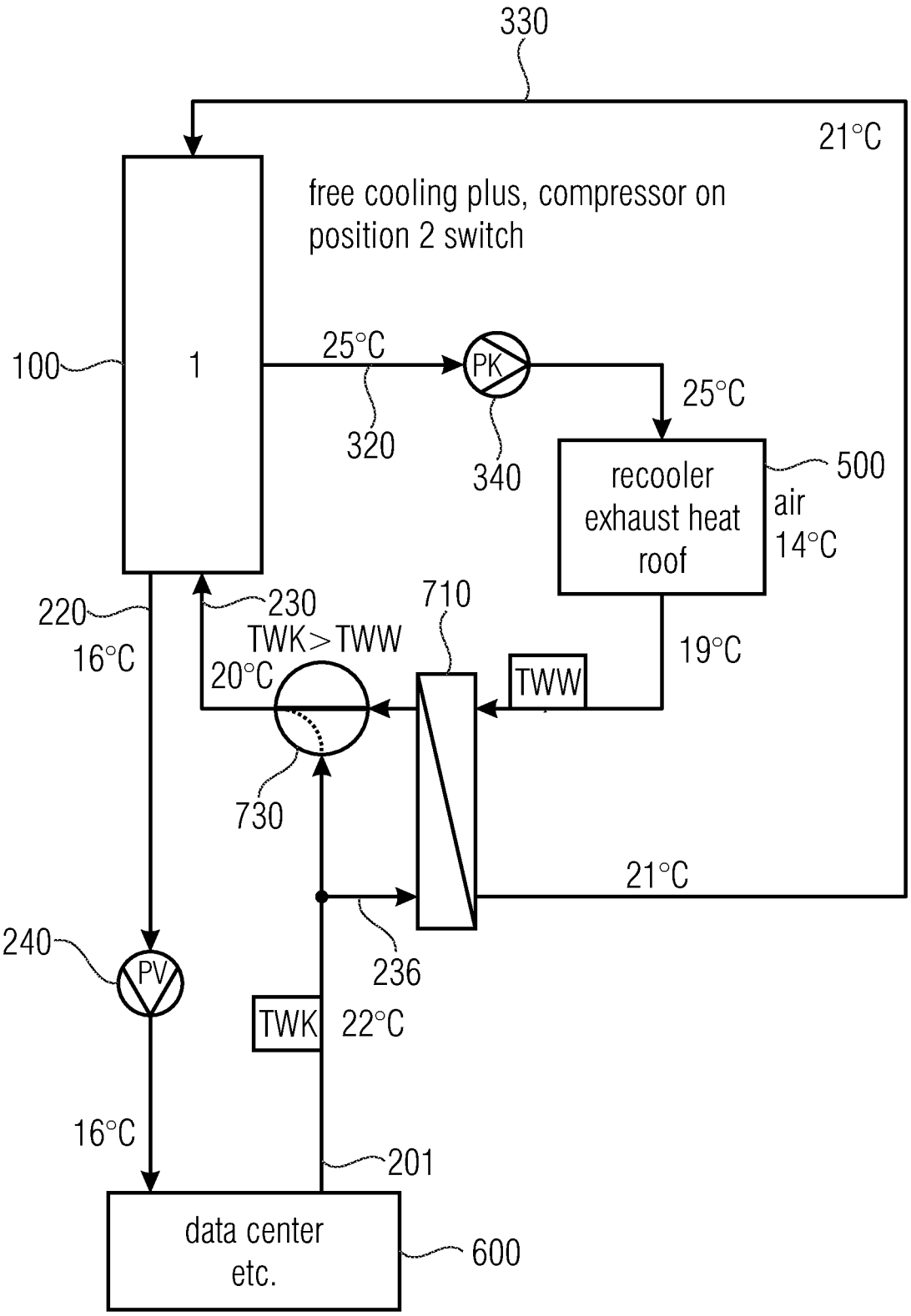
FIG. 3*a* is an implementation of the heat pump arrangement with two-way switch coupled to the evaporator cycle interface showing activated flow through the heat exchanger.
Figure 3B:
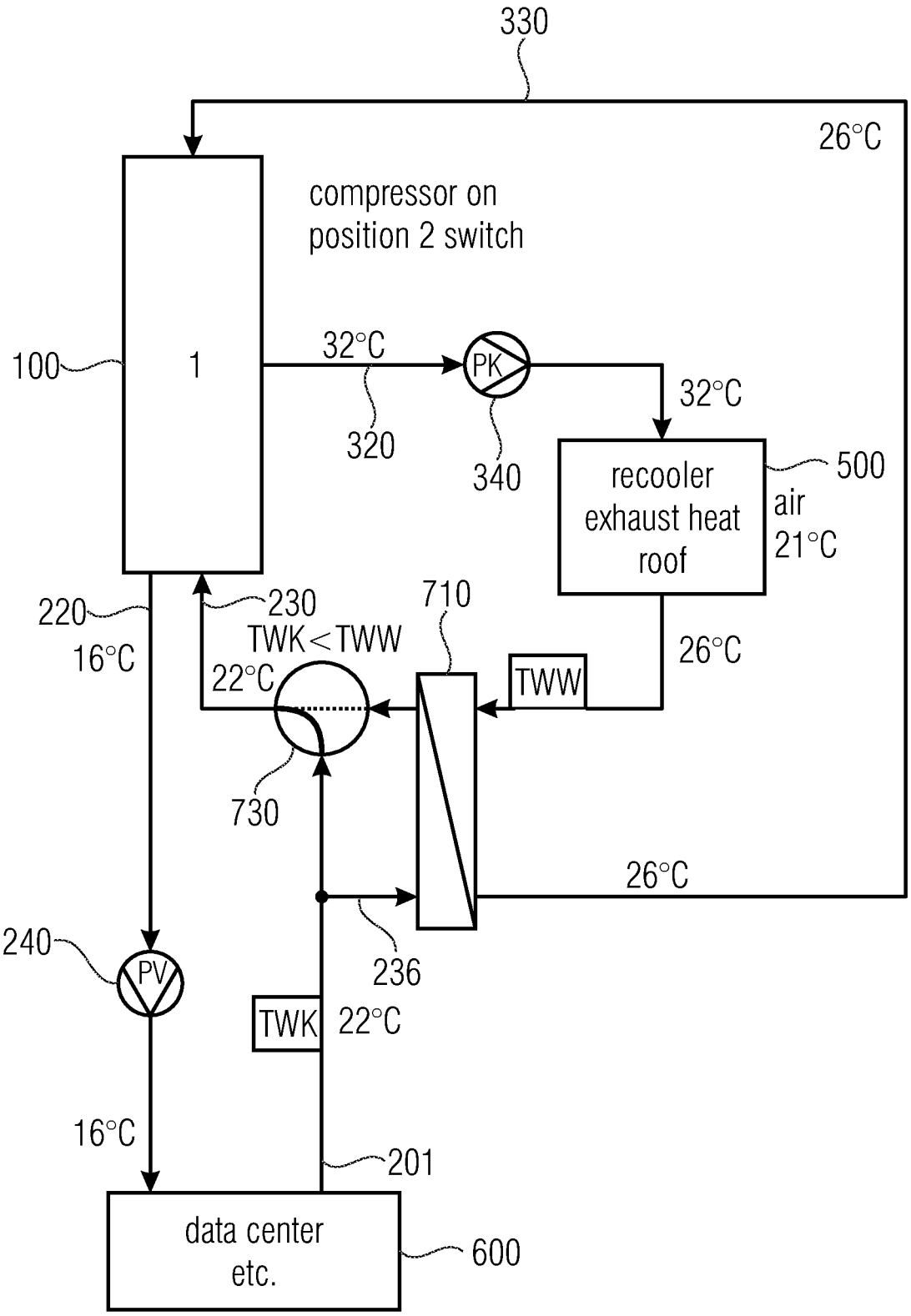
FIG. 3*b* is an implementation similar to FIG. 3*a* but with deactivated flow through the heat exchanger.

FIG. 3*a* shows an alternative implementation of the controllable heat exchanger with the heat exchanger unit 710 and the control element 730. Now, the first input of the first path of the heat exchanger unit 710 is firmly connected to the terminal 201 of the evaporator cycle interface 200 via a connecting line 236. Additionally, the control element 730 that is also merely coupled to the evaporator cycle interface has now two inputs and one output. In the embodiment shown in FIG. 3*a*, where free cooling is active, the first input is not coupled to the line for the liquid to be cooled 230 as shown by the dotted line inside the two-way switch 730. Instead, the second input of the control element is connected to the output of the first path of the heat exchanger unit 710 such that the heat exchanger unit 710 is continuously flowed-through by the liquid to be cooled. Thereby, it is achieved that the temperature of, for example, 22° C. is reduced to 20° C. in FIG. 3*a*, such that due to the relatively cool outside temperature in the range of 14° C. air temperature, free cooling takes a certain amount of "work" off the heat pump device 100 since now the liquid has to be cooled merely from 20° C. to 16° C. but no longer from 22° C. to 16° C. In FIG. 3*b*, the control element 730 is shown in its other position. Here, the heat exchanger 710 is again flowed-through continuously from the condenser side, i.e., from the condenser cycle. However, on the evaporator-cycle side, no liquid flow through the first path of the heat exchanger unit 710 is enabled since the output is no longer coupled to the second input as in FIG. 3*a* but to the first input.

As shown in FIG. 3*a*, control of the control element 730, i.e., which input is connected to the output takes place by comparing the two temperatures TWK and TWW. If TWK is higher than ZWW as determined by the control 400 of FIG. 1, free cooling is activated, while free cooling is deactivated when TWK is lower than TWW as shown in FIG. 3*b*, i.e., when the reflow temperature from the region to be cooled at the terminal 201 of the evaporator cycle interface 200 is less than the returned and re-cooled liquid in the condenser cycle at the output of the region to be heated 500 referred to as "recooler exhaust heat roof" in FIG. 3*b*.

While FIG. 2*a*, 2*b*, 2*c*, 3*a*, 3*b* show an arrangement of the control element 720, 730 in connection with the evaporator cycle interface while the condenser cycle interface is firmly coupled to the heat exchanger unit 710, the subsequently illustrated FIGS. 4*a*, 4*b*, 5*a*, 5*b* show an arrangement of the control element coupled to the condenser cycle interface 300, wherein here again the evaporator cycle interface 200 is firmly coupled to the heat exchanger unit 710 such that the heat exchanger unit 710 is continuously flowed-through from the return of the data center, i.e., the region to be cooled 600.

Therefore, in the embodiment shown in FIGS. 4*a* and 4*b*, the first path of the heat exchanger unit 710 is continuously coupled to the evaporator cycle interface 200, while the second path and here the input of the second path of the heat exchanger unit 710 is coupled to the control element, to a first output of the control element comprising one input and two outputs. In the embodiment shown in FIG. 4*a*, the temperature TWK is greater than the temperature TWW, such that free cooling is activated. Thus, the first output of the control element is coupled to the input and the liquid to be heated flows through the heat exchanger 710, in order to be heated from, for example, 17° C. in the example shown in FIG. 4*a* to 21° C., wherein at the same time the liquid to be cooled fed into the heat pump device is cooled from 22° C. to 18° C. on the line 230. Thereupon, the heated liquid is fed into the heat pump device 100 at the output of the second path of the heat exchanger unit 710 via the line 330 and there merely heated up to, for example, 23° C., wherein the heated liquid is output at line 320, out of the heat pump device into the condenser cycle interface and into the pump 340 which finally provides the liquid to the re-cooler or to the region to be heated 500, wherein so much energy is discharged to the air that liquid having a temperature of, for example, 17° C. is present at the output of the re-cooler.

If, however, it is determined that the evaporator cycle temperature TWK is lower than the condenser cycle temperature TWW, as determined by sensors 310 or 210, the control element is switched into the position of FIG. 4*b* where free cooling is deactivated and the liquid to be heated 330 no longer flows through the second path of the heat exchanger unit 700. Instead, the liquid to be heated is fed into the heat pump device 100 past the heat exchanger unit 710. In that way, the output 302 of the condenser cycle interface 300 is connected to the recooler or the region to be heated 500. Above that, the return from the region to be heated is connected to an input 303 of the condenser cycle interface. The condenser cycle temperature sensor 310 is configured to measure the temperature of the liquid in the terminal 303. The input of the control element is connected to the input 303 of the condenser cycle interface 300 independent of the position of the temperature sensor 310. As shown in FIG. 4*a*, in the case of free cooling, the first output is connected to the input and the first output is further connected to the first terminal of the second path of the heat exchanger unit 710. On the other hand, in the operating mode shown in FIG. 4*b*, the second output is connected to the input 330 of the heat pump device for the liquid to be heated.

FIGS. 5*a* and 5*b* show an alternative implementation of the control element 750, which is now no longer connected to the first input of the second path of the heat exchanger unit 710 as in FIGS. 4*a* and 4*b* but to the output of the second path of the heat exchanger unit 710. The control element 750 has two inputs and one output. In the embodiment shown in FIG. 5*b*, where free cooling is deactivated, i.e. wherein the normal mode is active, the first input of the control element 750 is connected to the output, wherein the output is again connected to the line 330 for the liquid to be heated that is fed into the heat pump device 100. The second input of the control element is firmly connected to the output of the second path of the heat exchange unit 710 and is connected to the one output of the control element 750 in the free cooling mode.

Although the control element 720, 730, 740, 750 is illustrated as two-way switches in FIG. 2*a* to 5*b*, either having two inputs and one output or two outputs and one input, instead, the two-way switch can also be implemented as a mixer or as any other control element that can influence one or several flow paths controlled by the control. The mixer is illustrated in FIG. 6 at 760 and has one input and two outputs. By the mixer, it can be achieved that part of the operating liquid, namely, for example, 70% of the operating liquid is guided past the heat exchanger unit 710 while the other part, namely, e.g., 30% is guided into the first path of the heat exchanger unit 710.

Thereby, for example, an operating liquid having a temperature of 20° C. is heated to 24° C. by the effect of the heat exchanger unit 710. Thus, an overall achieved temperature of 21° C. results at the branch point or at the combination point where the output 712 of the first path is connected to the line for the liquid to be cooled 230. Thus, by implementing the control element 760 as a mixer, in a configuration as shown in FIG. 2*a*, the temperature to be cooled can be heated in order to obtain a specific operating mode where a higher load than actually needed is demanded from the heat pump device 100 which is, however, of specific advantage in certain cases, for example to prevent clocking of the heat pump device 100. In the embodiment shown in FIG. 3, the control element 730 can also be replaced by a mixer that ensures that a specific portion, namely, e.g., the smaller portion enters the second input of the control element, such that also partial heating can be obtained when the mixer is placed at the position as illustrated in FIGS. 3*a* and 3*b* for the control element 730.

Similar implementations for the mixer can also be provided for the control elements 740, 750 of FIG. 4*a* to 5*b* in order to obtain a respective mixer effect even when the control element is placed on the condenser-cycle interface side.

Figure 8:
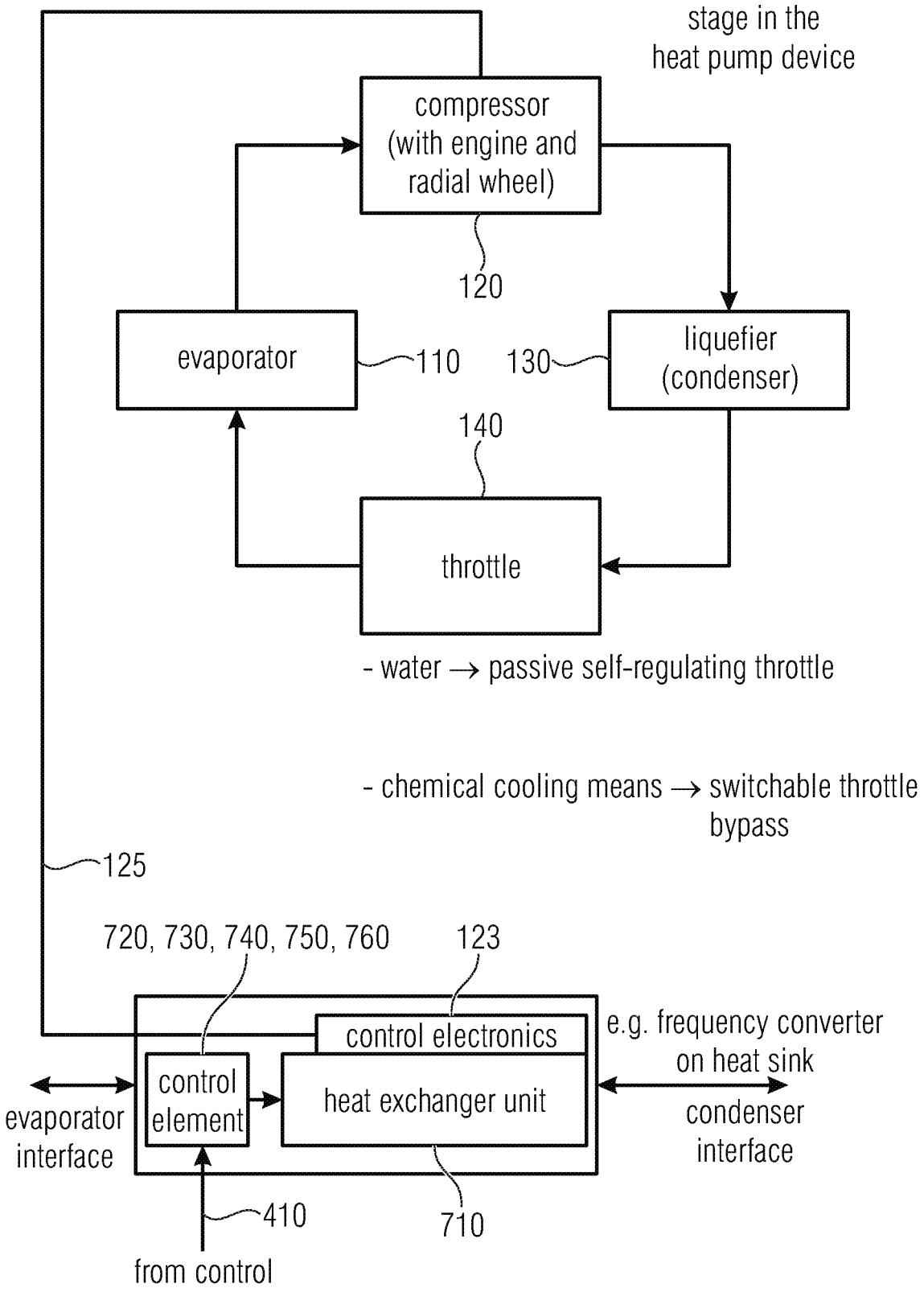
FIG. 8 is a schematic illustration of the heat pump device with allocated controllable heat exchange as cooling for the control electronics.

FIG. 8 shows a specific implementation of the heat pump device 100. In one embodiment, the heat pump device 100 includes a condenser 110. In the condenser, operating liquid is condensed. The condensed operating liquid is compressed by a compressor 120, configured as a motor having a radial wheel and thereby raised to a higher temperature level. The compressed vapor is then supplied to a liquefier (condenser) 130. Further, depending on the implementation, for controlling the balance of the operating liquid, a throttle 140 can be provided. If water is used as operating medium within the heat pump device, a passive self-regulating throttle can be used as a throttle. If, however, so-called chemical cooling means, i.e., cooling means differing from water, are used, instead of a passive self-regulating throttle, a switchable throttle bypass can be implemented in the throttle 140.

Further, it should be noted that in the heat pump device 100 not only such a stage as illustrated in FIG. 8 by elements 110 to 140 can be implemented but also two or more than two stages combined in any manner can be included in the heat pump device. The one or several stages are connected to the evaporator-side interface on the input side or evaporator side and are coupled to the "outside world" by the condenser-cycle interface on the output side or condenser side.

Further, FIG. 8 shows an implementation of the controllable heat exchanger 700 with a control element, for example a control element 720, 730, 740, 750, 760 and an allocated heat exchanger unit 710. The control electronics or an electric control unit 123 comprising, for example, a frequency converter switch for the stator-side coil control of the electric motor in the compressor 120, power electronics, a rectifier or control electronics is placed on the heat exchanger unit 710. This ensures that the control electronics is maintained at the temperature of the heat exchanger unit 710 or is cooled by the heat exchanger unit 710, since the same would become significantly hotter. Alternatively, the same can also be placed in a thermal interaction arrangement, e.g., by means of a specific heat transfer means, such that a cooling effect also occurs even when the control electronics on the one hand and the heat exchanger unit 710 on the other hand do not touch directly. The heat transfer means has a thermal conductivity that is at least ten times higher than a thermal conductivity of an air path having the same length.

Since in one embodiment the heat exchanger unit 710 is continuously flowed-through by the condenser cycle or by the evaporator cycle, cooling takes place at all times. The temperatures in the condenser cycle which can be above 20° C. are sufficient as cooling temperatures for the electronic arrangement. Therefore, it is advantageous to couple the heat exchanger unit 710 to the condenser cycle interface such that the heat exchanger unit 710 or a second path of the same is flowed-through by the condenser cycle. Thereby, the exhaust heat of the control electronics enters the condenser cycle directly and hence into the exhaust heat apparatus without having to be "pumped" first from the evaporator cycle into the condenser cycle.

FIG. 7 shows a tabular overview of several modes that can be effected, for example, by a two-way switch as illustrated in FIGS. 2*a* to 5*b*.

In particular in a cold temperature range where an exemplary air temperature is lower than 10° C. and wherein the sensor values are such that TWK is higher than TWW, free cooling is active. Further, the controllable heat exchanger is flowed-through from both sides, i.e., the same is active. Above that, as exemplarily shown in FIG. 2*c*, the compressor is deactivated, i.e., switched off. Controlling the temperature can be obtained, for example, in that the condenser-side pump 340 included in the condenser cycle interface 300 is controlled. If it is determined that the temperature of the cooled liquid becomes lower than a set temperature, the pump 340 can be throttled. If it is, however, determined that the temperature becomes too high, the pump 340 can be rotated faster again. Alternatively or additionally, a fan typically present in the recooler 500 can be rotated faster or slower in order to obtain more or less cooling capacity.

In a medium cold temperature range, which is, for example, between 10° C. and 16° C., free cooling is also active. Above that, the compressor is also active and regulation of the temperature fed into the data center or the region to be cooled can take place in that the speed of the radial wheel in the compressor is controlled. If higher cooling capacity is needed, the speed is increased. If, however, lower cooling capacity is needed, the speed of the radial wheel is reduced.

In a normal operating mode which is activated in a warm temperature range, where the temperatures are, for example more than 16° C., it is typically determined that the temperature TWK is lower than the temperature TWW. Then, the controllable heat exchanger 710 is deactivated, i.e., switched to inactive and cooling capacity control can take place again via the speed of the radial wheel. In this mode, i.e., in the warm temperature range, no free cooling is active.

As a special mode where a mixer as described with reference to FIG. 6 can be used at positions that are illustrated by elements 720 to 750 in FIGS. 2*a* to 5*b*, a controllable short circuit can be obtained between the output or the condenser cycle and the input or the evaporator cycle of the heat pump device. In particular at high outside temperatures on the one hand and relatively low power requirements of the data center since there is, for example, merely partial load operation, at the other hand, the situation can occur that without the special mode with controllable short circuit the control would transition to on-off clocking, which is not advantageous for several reasons.

Thus, according to the invention, the special mode with controllable short circuit is activated, which is detected, for example, by a specific clocking frequency. If a too high clocking frequency is determined, the controllable short circuit is activated, therefore a typically smaller part, i.e., a part less than 50% of the flow amount is fed into the respective first or second path of the heat exchanger unit and combined again with the other (typically greater) portion at the output of the heat exchanger unit. This mixer effect that has been illustrated in FIG. 6 as 70/30 can possibly, as illustrated in FIG. 7 in the last line of the table, be controlled depending on the implementation, i.e., from 1%/99% control to a 51%/49% control. In any case, it is advantageous that the larger part of the flow passes the heat exchange element 710 and merely the smaller part of the flow passes through the heat exchange element 710 wherein, as already mentioned, the proportion of the smaller flow can be controlled from 0 to 50% depending on the implementation of the mixer.

In embodiments of free cooling plus, a heat exchanger and a three-way switch are installed. This three-way switch can be incorporated on the cold water side or the warm water side and is to enable or disable the flow through the heat exchanger. Depending on the implementation, pumps PV 240 or PK 340 might be present or not. Above that, additional heat exchanges can be used, for example at the output of pump PV 240 or at the output of pump PK 340, although these heat exchanges are not illustrated in FIG. 3*a* and the other figures. For free cooling plus, water as cooling means offers, due to its bad volumetric cooling capacity, the advantage that by a radial compression controlled by speed, volume flow and pressure ratio can be adjusted and in that way an almost ideal operating point of the system results in a broad field of usage, wherein the same can already be obtained at small cooling capacities below 50 KW. In the shown implementations, water is cooled, for example, from 20° C. to 16° C., although other temperatures are possible, such as cooling to 20° C. from a higher temperature of 26° C. Generally, it is achieved that the cooling capacity reaches a temperature level with as little expenditure of energy as possible to output the capacity again to the environment, depending on the outside temperature. If a temperature that allows that the entire cooling capacity can be transferred from the cold water to the cooling water by the upstream heat exchanger comes from the roof (recooler), no compressor work is needed. If the environmental temperatures rise further, such that no 20° C. cold water results without compressor operation, the compression cooling system is connected in a capacity-controlled manner in order to provide the lacking part, for example 3° C. or 50% power. If the outside temperatures continue to rise and the cooling water reaches temperatures of, for example, 25° C. and more, practically no energy can be transferred anymore by the heat exchanger. Now, the entire cooling capacity has to be provided by the compression cooling machine. If the cooling water temperatures rise further, in this region above 26° C., the three-way switch has to disable the flow through the heat exchanger at least on one side, otherwise the cooling system would have to provide more cooling capacity than needed by the application.

In specific alternative embodiments, it is advantageous that the control, i.e., whether the heat transfer is flowed-through or not, merely depends on the temperatures TWW and TWK, namely when the temperature TWW is lower than TWK, the heat exchanger unit is flowed-through. If the temperature in the evaporator is higher than the flow temperature on the cold water side or customer side, the compressor has to work. If, however, the temperatures in the free cooling mode are below the requested customer temperature, here 16° C., the fan on the roof and the finally the pumps can be throttled.

In an embodiment of the present invention, a throttle is used for free-cooling plus that already safely operates without pressure difference or starting from a small pressure difference less than 10 mbar up to the maximum pressure stroke. Then, it is ensured that the cooling means balance is compensated from the liquefier to the evaporator when respective liquid compensation functionality is needed. This is in contrast to known cooling systems having electronic throttles that only operate at pressure differences of several bar.

Above that, it is advantageous to use a flow machine as a compressor such that the needed pressure difference and the power, for example the mass flow, can be exactly controlled via the speed. Further, water is used as cooling means, wherein small pressure differences of less than 100 mbar are possible across the entire operating range and wherein further a self-regulating throttle can be incorporated due to the extreme volume differences between vapor and liquid. In order to be able to work with so-called chemical cooling means, i.e., cooling means differing from water, it is advantageous to use a switchable throttle bypass instead of the passive self-regulating throttle as illustrated in FIG. 8 in order to get cooling means from the high-pressure side back to the low-pressure side.

As has already been illustrated and has been explained based on FIG. 6, it is advantageous to configure the three-way switch as a mixer in order to optimize the partial load method of the system. For compression, flow machines are used which have a speed-dependent volume flow and a speed-dependent pressure increase. For the cooling capacity, the mass flow is decisive. If a high pressure increase (partial performance in the data center and high environmental temperatures) is requested from the system at low cooling capacity, this results in a volume flow that is too large and hence a mass flow that is too large. This results in clocking of the systems (on . . . off . . . on). If the three-way switch is replaced by a mixer, a controllable power short circuit can be provided between cold water and cooling water which improves the partial load behavior and effectively prevents clocking.

One branch flows continuously through the heat exchanger unit in the controllable heat exchanger. Therefore, the heat exchanger is perfectly suitable for cooling capacity electronics. If the mixer is brought to the cold water side, the electronics introduces its losses directly into the cooling water side, i.e., into the condenser cycle. This has the advantage that the heat pump device does not have to provide the power loss first to the exhaust heat side by compressor work. The rectifiers for the frequency converter circuits are arranged on the heat exchanger unit, i.e., in thermal operative connection with the controllable heat exchanger.

A method for producing a heat pump arrangement having a heat pump device comprises the following steps:

Inputting liquid to the cooled into the heat pump device and outputting cooled liquid out of the heat pump device;

Inputting liquid to be heated into the heat pump device and outputting heated liquid out of the heat pump device; and Coupling a liquid cooled by a heat sink in a controllable and thermal manner to the liquid to be cooled via a controllable heat exchanger in dependence on an evaporator cycle temperature having a temperature of the liquid to be cooled or the cooled liquid or in dependence on a condenser cycle temperature having a temperature of the liquid to be heated or the heated liquid or the liquid cooled by the heat sink.

Although specific elements have been described as apparatus elements, it should be noted that this description is equally to be considered as the description of steps of a method and vice versa.

Further, it should be noted that a control, for example, effected by the element 400 in FIG. 1, can be implemented as software or hardware. The implementation of the control can take place on a non-volatile memory medium, a digital or other memory medium, in particular a disk or CD having electronically readable control signals that can cooperate with a programmable computer system such that the respective method for operating a heat pump is performed. Thus, the invention generally also includes a computer program product with a program code stored on a machine readable carrier for performing the method when the computer program product runs on a computer. In other words, the invention can also be realized as a computer program having a program code for performing the method when the computer program runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A heat pump arrangement, comprising:

a heat pump device;

an evaporator cycle interface configured for inputting a liquid to be cooled into the heat pump device and configured for outputting a cooled liquid out of the heat pump device;

a condenser cycle interface configured for inputting a liquid to be heated into the heat pump device and configured for outputting a heated liquid out of the heat pump device;

a controllable heat exchanger configured for controllably coupling the evaporator cycle interface and the condenser cycle interface, the controllable heat exchanger comprising a controllable short circuit, wherein the controllable short circuit, when activated, is such that power requirements for the heat pump device are increased compared to power requirements in case of a deactivated controllable short circuit; and wherein a controller is configured:

to activate cooling of the liquid to be cooled by the liquid to be heated using the controllable heat exchanger when a condenser cycle temperature as sensed by the condenser cycle temperature sensor of the liquid to be heated is lower than an evaporator cycle temperature as sensed by the evaporator cycle temperature sensor of the liquid to be cooled for a first temperature range, wherein the controllable short circuit is deactivated, to prevent cooling of the liquid to be cooled by the liquid to be heated using the controllable heat exchanger when the condenser cycle temperature as sensed by the condenser cycle temperature sensor of the liquid to be heated is higher than the evaporator cycle temperature as sensed by the evaporator cycle temperature sensor of the liquid to be cooled for a second temperature range, wherein the controllable short circuit is deactivated, and to activate the controllable short circuit of the controllable heat exchanger for a third temperature range, wherein the controllable heat exchanger, when the controllable short circuit of the controllable heat exchanger is activated, is configured to heat the liquid to be cooled in the evaporator cycle interface using the liquid to be heated in the condenser cycle interface or using the heated liquid in the condenser cycle interface, and wherein the first temperature range comprises first temperatures, wherein the second temperature range comprises second temperatures, and wherein the third temperature range comprises third temperatures, the second temperatures being higher than the first temperatures, and wherein the third temperatures being higher than the second temperatures.

2. Heat pump arrangement according to claim 1, wherein the controllable heat exchanger comprises a heat exchanger unit with four terminals and two fluidically separated paths and at least one control element fluidically coupled to the evaporator cycle interface, wherein the at least one control element fluidically coupled to the evaporator cycle interface is configured as a two-way switch or a mixer, wherein the two-way switch is configured as a passive two-way switch in order to effect or prevent the flow through one path of the two fluidically separated paths of the heat exchanger unit in dependence on the setting of the passive two-way switch, or wherein the mixer is configured as a passive mixer to reduce the flow through one path of the two fluidically separated paths of the heat exchanger unit in dependence on the setting of the passive mixer, or wherein the controller is configured to control the at least one control element such that the flow through one path of the two fluidically separated paths is effected when the condenser cycle temperature is at a predetermined ratio to the evaporator cycle temperature or lower than a predetermined condenser cycle temperature threshold, or wherein the controllable heat exchanger is configured such that a first path of the two fluidically separated paths of the heat exchanger unit can be continuously flowed-through independent of the controller and a second path of the two fluidically separated paths of the heat exchanger unit can be switched on or off or can be throttled with respect to an on-state by the controller.

3. The heat pump arrangement according to claim 1, wherein the controllable heat exchanger comprises a heat exchanger unit with four terminals and two fluidically separated paths and at least one control element fluidically coupled to the evaporator cycle interface, wherein the at least one control element comprises an input terminal, a first output terminal and a second output terminal, wherein the input terminal is connected to an output of the region to be cooled, wherein the first output terminal is connected to the first terminal of the heat exchanger unit, and wherein the second output terminal is connected to an input into the evaporator cycle interface for inputting the liquid to be cooled into the heat pump device, or wherein the at least one control element comprises a first input terminal, a second input terminal, and a first output terminal, wherein the first input terminal is connected to an output of the region to be cooled, wherein the second input terminal is connected to the second terminal of the heat exchanger unit, and wherein the output terminal is connected to an input into the evaporator cycle interface for inputting the liquid to be cooled into the heat pump device.

4. The heat pump arrangement according to claim 1, wherein the evaporator cycle interface comprises an input terminal to the heat pump device for the cooled liquid, and an output terminal to the heat pump device for the liquid to be cooled, and wherein the evaporator cycle interface is connected to the region to be cooled and to the controllable heat exchanger, wherein the evaporator cycle interface further comprises an evaporator cycle pump configured for circulating the liquid to be cooled or the cooled liquid, or wherein the condenser cycle interface comprises an input terminal to the heat pump device for the heated liquid, and an output terminal to the heat pump device for the liquid to be heated, and wherein the condenser cycle interface is connected to the region to be heated and to the controllable heat exchanger, wherein the condenser cycle interface further comprises a condenser cycle pump that is configured to circulate the heated liquid or the liquid to be heated, or wherein the evaporator cycle interface comprises an input terminal to the heat pump device for the cooled liquid, an output terminal to the heat pump device for the liquid to be cooled, and the evaporator cycle temperature sensor, and wherein the evaporator cycle interface is connected to the region to be cooled and to the controllable heat exchanger, wherein the evaporator cycle interface further comprises an evaporator cycle pump configured for circulating the liquid to be cooled or the cooled liquid, and wherein the evaporator cycle temperature sensor is configured to detect a temperature of the liquid to be cooled before the liquid to be cooled enters the controllable heat exchanger, or wherein the condenser cycle interface comprises an input terminal to the heat pump device for the heated liquid, an output terminal to the heat pump device for the liquid to be heated, and the condenser cycle temperature sensor, and wherein the condenser cycle interface is connected to a region to be heated and to the controllable heat exchanger, wherein the condenser cycle interface further comprises a condenser cycle pump that is configured to circulate the heated liquid or the liquid to be heated, wherein the condenser cycle temperature sensor is configured to detect a temperature of the liquid to be heated before the liquid to be heated enters the controllable heat exchanger.

5. The heat pump arrangement according to claim 1, wherein the controller is configured to prevent cooling of the liquid to be cooled by the liquid to be heated using the controllable heat exchanger and to perform, in dependence on a requested cooling capacity, a speed regulation of a radial wheel of a compressor in the heat pump device when the condenser cycle temperature as sensed by a condenser cycle temperature sensor of the liquid to be heated is higher than the evaporator cycle temperature as sensed by an evaporator cycle temperature sensor of the liquid to be cooled for the second temperature range, or to activate cooling of the liquid to be cooled by the liquid to be heated using the controllable heat exchanger and to increase or decrease a speed of a radial wheel within a compressor of the heat pump device in dependence on a requested cooling capacity or to deactivate the compressor in the heat pump device when the condenser cycle temperature as sensed by the condenser cycle temperature sensor of the liquid to be heated is lower than a predetermined temperature of the liquid to be cooled or the cooled liquid as sensed by the evaporator cycle temperature sensor for a first subrange of the first temperature range, or to activate cooling of the liquid to be cooled by the liquid to be heated using the controllable heat exchanger and to throttle a circulation pump arranged in the condenser cycle interface with respect to a set speed when the condenser cycle temperature as sensed by the condenser cycle temperature sensor of the liquid to be heated is equal to or lower than a predetermined temperature of the liquid to be cooled or the cooled liquid as sensed by the evaporator cycle temperature sensor for a second subrange of the first temperature range, wherein the second subrange comprises lower temperatures than the first subrange.

6. The heat pump arrangement according to claim 1, wherein the controller is configured to detect a specific state of the heat pump device, wherein the specific state of the heat pump device is such a state, in which the controllable short circuit of the controllable heat exchanger when activated by the controller results in an improved operating behavior of the heat pump device, and wherein the controller is configured to activate the controllable short-circuit of the controllable heat exchanger only when the specific state of the heat pump device has been detected by the controller.

7. The heat pump arrangement according to claim 1, wherein the controllable heat exchanger comprises a heat exchanger unit with four terminals and two fluidically separated paths and at least one control element fluidically coupled to the evaporator cycle interface, wherein the at least one control element fluidically coupled to the evaporator cycle interface is configured as a mixer, wherein the mixer is configured to bring, in the controllable short circuit when activated by the controller, a first portion of a liquid that can be circulated in the condenser cycle interface or the evaporator cycle interface into thermal operative connection to a liquid of the respective other interface and to bring a second portion of the liquid that can be circulated in the condenser cycle interface or the evaporator cycle interface not into thermal operative connection to the liquid of the respective other interface, wherein the first portion is smaller than the second portion.

8. The heat pump arrangement according to claim 7, wherein the mixer is controllable by the controller to control a ratio of the first portion to the second portion in dependence on an operating behavior of the heat pump device.

9. The heat pump arrangement according to claim 1, wherein the heat pump device comprises a compressor that is configured to be switched off in a switch-off even when the cooled liquid falls below a predetermined temperature as sensed by the evaporator cycle temperature sensor, or when the heated liquid exceeds a predetermined temperature as sensed by the condenser cycle temperature sensor, and wherein the controller is configured to detect a clocking frequency of the switch-off events and to activate, at the clocking frequency of the switch-off events being higher than a clocking frequency threshold, the controllable short circuit of the controllable heat exchanger, so that, due to the activated controllable short circuit of the controllable heat exchanger, the clocking frequency of the switch-off events is reduced or an occurrence of the switch-off events is eliminated.

10. The heat pump arrangement according to claim 1, wherein the evaporator cycle interface is configured to be coupled to the region to be cooled directly or via a heat exchanger, or wherein the condenser cycle interface is configured to be coupled to the region to be heated directly or via a heat exchanger.

11. The heat pump arrangement according to claim 1, wherein the evaporator cycle interface is configured to hold a first operating liquid, wherein the condenser cycle interface is configured to hold a second operating liquid, wherein the second operating liquid differs from the first operating liquid, or wherein the second operating liquid is $CO_2$ and the first operating liquid is water or wherein the first operating liquid is water or $CO_2$ and the second operating liquid is a water glycol mixture.

12. The heat pump arrangement according to claim 1, wherein the heat pump device comprises one or several stages, wherein one stage comprises an evaporator, a compressor, a condenser, and a throttle, wherein the stage is configured to use water as an operating medium, and wherein pressure differences between the evaporator and the condenser are below 300 mbar in an entire operating range, wherein the compressor comprises a radial wheel that is speed-controllable in dependence on a requested power of the heat pump device, and wherein the throttle is a self-regulating passive throttle, or wherein the heat pump device comprises one or several stages, wherein one stage comprises an evaporator, a compressor, a condenser, and a throttle, wherein the stage is configured to use a chemical medium as an operating medium, wherein a pressure difference between the evaporator and the condenser is greater than 5 bar, and wherein the compressor comprises a radial wheel that is speed-controllable in dependence on a requested power of the heat pump device, and wherein the throttle comprises a switchable throttle bypass in order to bring the operating medium from the condenser back into the evaporator.

13. A heat pump system, comprising:

a region to be cooled;

a region to be heated; and a heat pump arrangement comprising:

a heat pump device;

an evaporator cycle interface configured for inputting a liquid to be cooled into the heat pump device and configured for outputting a cooled liquid out of the heat pump device;

a condenser cycle interface configured for inputting a liquid to be heated into the heat pump device and configured for outputting a heated liquid out of the heat pump device;

a controllable heat exchanger configured for controllably coupling the evaporator cycle interface and the condenser cycle interface, the controllable heat exchanger comprising a controllable short circuit, wherein the controllable short circuit, when activated, is such that power requirements for the heat pump device are increased compared to power requirements in case of a deactivated controllable short circuit; and a controller configured for controlling the controllable heat exchanger in dependence on an evaporator cycle temperature in the evaporator cycle interface or a condenser cycle temperature in the condenser cycle interface, wherein the controller is configured to to activate cooling of the liquid to be cooled by the liquid to be heated using the controllable heat exchanger when a condenser cycle temperature as sensed by the condenser cycle temperature sensor of the liquid to be heated is lower than an evaporator cycle temperature as sensed by the evaporator cycle temperature sensor of the liquid to be cooled for a first temperature range, wherein the controllable short circuit is deactivated, to prevent cooling of the liquid to be cooled by the liquid to be heated using the controllable heat exchanger when the condenser cycle temperature as sensed by the condenser cycle temperature sensor of the liquid to be heated is higher than the evaporator cycle temperature as sensed by the evaporator cycle temperature sensor of the liquid to be cooled for a second temperature range, wherein the controllable short circuit is deactivated, and to activate the controllable short circuit of the controllable heat exchanger for a third temperature range, wherein the controllable heat exchanger, when the controllable short circuit of the controllable heat exchanger is activated, is configured to heat the liquid to be cooled in the evaporator cycle interface using the liquid to be heated in the condenser cycle interface or using the heated liquid in the condenser cycle interface, wherein the evaporator cycle interface is coupled to the region to be cooled, and wherein the condenser cycle interface is coupled to the region to be heated.

14. A method for producing a heat pump arrangement with a heat pump device, comprising:

inputting a liquid to be cooled into the heat pump device and outputting a cooled liquid out of the heat pump device;

inputting a liquid to be heated into the heat pump device and outputting a heated liquid out of the heat pump device;

coupling liquid cooled by a region to be heated in a controllable and thermal manner to the liquid to be cooled via a controllable heat exchanger in dependence on an evaporator cycle temperature comprising a temperature of the liquid to be cooled or the cooled liquid or in dependence on a condenser cycle temperature comprising a temperature of the liquid to be heated or the heated liquid or the liquid cooled by the region to be heated, the controllable heat exchanger comprising a controllable short circuit, wherein the controllable short circuit, when activated, is such that power requirements for the heat pump device are increased compared to power requirements in case of a deactivated controllable short circuit, activating cooling of the liquid to be cooled by the liquid to be heated using the controllable heat exchanger when a condenser cycle temperature as sensed by the condenser cycle temperature sensor of the liquid to be heated is lower than an evaporator cycle temperature as sensed by the evaporator cycle temperature sensor of the liquid to be cooled for a first temperature range, wherein the controllable short circuit is deactivated, preventing cooling of the liquid to be cooled by the liquid to be heated using the controllable heat exchanger when the condenser cycle temperature as sensed by the condenser cycle temperature sensor of the liquid to be heated is higher than the evaporator cycle temperature as sensed by the evaporator cycle temperature sensor of the liquid to be cooled for a second temperature range, wherein the controllable short circuit is deactivated, and activating the controllable short circuit of the controllable heat exchanger for a third temperature range, wherein the controllable heat exchanger, when the controllable short circuit of the controllable heat exchanger is activated, is configured to heat the liquid to be cooled in the evaporator cycle interface using the liquid to be heated in the condenser cycle interface or using the heated liquid in the condenser cycle interface.

15. The heat pump arrangement according to claim 1, wherein the controllable heat exchanger comprises a heat exchanger unit with four terminals and two fluidically separated paths and at least one control element fluidically coupled to the evaporator cycle interface, wherein a third terminal of the four terminals and a fourth terminal of the four terminals are connected, wherein a second path of the two fluidically separated paths extends between the third terminal and the fourth terminal, and wherein the liquid to be heated leaves the second path via the fourth terminal and the heated liquid enters the second path via the third terminal after cooling in a region to be heated, wherein a first terminal of the four terminals and a second terminal of the four terminals are connected, so that a first path of the two fluidically separated paths extends between the first terminal and the second terminal, and wherein the first terminal of the heat exchanger unit or the second terminal of the heat exchanger unit is coupled to at least one terminal of the at least one control element in order to effect, reduce or prevent a flow through the first path of the two fluidically separated paths of the heat exchanger unit in dependence on a setting of the at least one control element, wherein the at least one control element fluidically coupled to the evaporator cycle interface is configured as a two-way switch or as a mixer.

* * * * *